United States Patent [19]

Weckerle

[11] Patent Number: 4,602,649

[45] Date of Patent: Jul. 29, 1986

[54] HOLDER-DISPENSER FOR SPREADABLE SUBSTANCES

[76] Inventor: Peter Weckerle, Otto Hahn Strasse 12, 8123 Peissenberg, Fed. Rep. of Germany

[21] Appl. No.: 665,109

[22] Filed: Oct. 26, 1984

Related U.S. Application Data

[63] Continuation-in-part of Ser. No. 919,543, Jun. 27, 1978, abandoned.

[51] Int. Cl.[4] ..... A45D 40/00

[52] U.S. Cl. ..... 132/79 C

[58] Field of Search ..... 132/79 R, 79 A, 79 C, 132/82 A, 88.5, 88.7, DIG. 3; 401/55, 58, 75, 76, 77, 78, 79, 88, 95, 174

[56] References Cited

U.S. PATENT DOCUMENTS 2,274,311 2/1942 Wehn ..... 132/79 C
2,979,029 4/1961 Melnikoff ..... 401/79
3,232,276 2/1966 Kupersmith et al. ..... 401/75

FOREIGN PATENT DOCUMENTS 1047279 12/1953 France .
956651 4/1965 United Kingdom .

*Primary Examiner*—Robert Peshock

[57] ABSTRACT

A pencil (1), more especially a cosmetic pencil comprises a handle part (2), a plunger (3) which is received therein and a sleeve-shaped screw part (4), into which is filled a spreadable body (5). The screw part (4) is arranged so as to be rotatable with respect to the handle part (2) and has been screwed on the plunger (3) which is provided with an external thread (12). The screw part (4) is held on the handle part (2) so as to be undisplaceable in the axial direction. The plunger (3) is held in the handle part (2) so as to be secured against rotation and so as to be axially movable. By this means, the plunger (3) is moved into the screw part (4) when the screw part (4) is rotated.

10 Claims, 6 Drawing Figures

HOLDER-DISPENSER FOR SPREADABLE SUBSTANCES

REFERENCE TO PRIOR APPLICATION

This application is a continuation-in-part of my earlier U.S. application Ser. No. 919,543 filed June 27, 1978 and now abandoned.

FIELD OF THE INVENTION

This invention relates, as does my prior U.S. application, to a holder-dispenser for spreadable substances. It relates more specifically to a pencil, more particularly a cosmetic pencil comprising, as does my prior holder dispenser, a casing (herein referred to as a handle part), a ram (herein referred to as a plunger) and a hollow sleeve (herein referred to as a sleeve-shaped screw part). As in my prior application, the sleeve-shaped screw part is filled with a body capable of being spread and is rotatable with respect to the handle part and is moreover screwed on the plunger provided with an external thread.

BACKGROUND OF THE INVENTION

In my earlier application, the threaded plunger is fixed within the handle part against both rotational and longitudinal movement relative thereto so that on rotation of the sleeve-shaped screw part on the threaded plunger, the sleeve-shaped screw part is moved inwardly into the handle part whereby to expose the spreadable substance for use. This occurs because the spreadable substance filled in the sleeve-shaped screw part can not follow the inward movement of the sleeve-shaped screw part because such movement is blocked by the fixed plunger. With this arrangement, the screw part is screwed into the handle part to an increasing extent corresponding to the comsumption of the usable body. As a result, a point is reached when holding the pencil becomes difficult as, for example, when the spreadable body is virtually consumed.

SUMMARY OF THE INVENTION

This invention provides a holder dispenser, more especially a cosmetic pencil, wherein, in spite of the consumption of the spreadable body as a result of use, the total length of the pencil, in other words the handle part and screw part received therein, remains unchanged and the pencil can thus still be easily handled even when the spreadable body is virtually used up.

The invention provides a holder dispenser of a cosmetic pencil type comprising a hollow handle part, an externally threaded plunger within said handle part fixed against rotative movement relative thereto, and a rotatable sleeve-shaped screw part fitted at least in part within said hollow handle part between and in partial engagement with the inner surface of the handle part and the outer surface of the threaded plunger, said screw part being formed in its inner surface at its inner end portion, within said hollow handle part, with thread engaging means for engaging the external threads on said plunger.

The arrangement is such that the screw part, while rotatable, is held on the handle part against movement in the axial direction while the plunger part, though enabled for movement in the axial direction, is restrained against rotational movement. Accordingly, when, during use of the pencil, the screw part is rotated, the plunger, which is axially displaceable in the handle part, is inserted into the interior of the screw part and presses out the spreadable body from the screw part. By this means, the spreadable body is extended from the screw part without shortening the handle part. This allows the pencil to be easily handled at any time, that is to say even if the sppreadable body has been nearly used up.

Expediently, the screw part is held in the handle part by way of a snap connection, which facilitates the assembly of the pencil and also permits the exchange of an empty screw part for a filled screw part. The snap connection can be realised in a simple manner as far as the production technique is concerned, in that there projects from the inside wall of the handle part an internal bulge which co-operates with an annular groove, which has been expediently produced by pressing, in the screw part.

Good centering and stable supporting of the cosmetic pencil are ensured in that the internal bulge of the handle part and the annular groove in the screw part are provided at a distance from the respective end of the handle part and the screw part respectively.

An advantageous securing against rotation of the spreadable body inside the screw part, for the purpose of subsequently sharpening the pencil, is expediently brought about by longitudinal ribs on the internal wall of the screw part. However, also expedient is a non-circular design of the internal cross section of the screw part, which is advantageously formed by a metal sleeve, whereas the handle part and the plunger may be made of plastics material.

BRIEF DESCRIPTION OF THE DRAWINGS

Hereinafter, an exemplified embodiment of the invention will be described with reference to the drawing, in which.

BRIEF DESCRIPTION OF THE INVENTION

Figure 1:
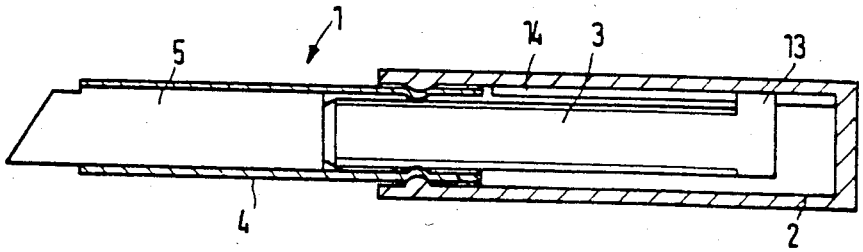
FIG. 1 shows a sectional view of a construction form of a cosmetic pencil according to the invention.

The cosmetic pencil generally marked with the reference symbol 1 in FIG. 1 consists substantially of three components, namely a handle part 2, a plunger 3 received therein as well as a screw part 4. For the sake of clarity, the closing cap, which is plugged on from the left-hand side in the illustration of FIG. 1, is not shown.

Figure 2:
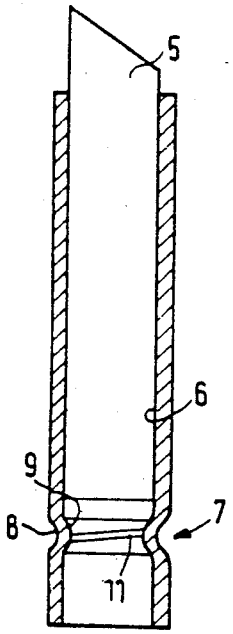
FIG. 2 shows a sectional view through the screw part of the pencil shown in FIG. 1.
Figure 3:
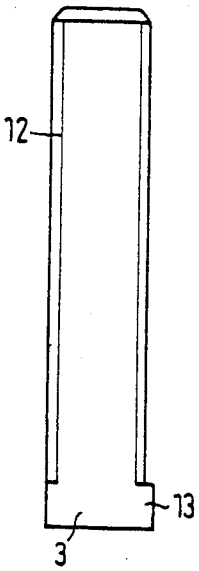
FIG. 3 shows a view of the plunger.
Figure 4:
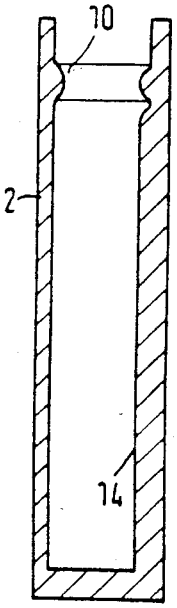
FIG. 4 shows a sectional view of the handle part.

As can be seen particularly clearly in FIG. 2, the screw part 4 is formed by a tubular sleeve, in which a spreadable body 5 has been received—to be more precise, into which it has been filled. The spreadable body may be a lip-stick compound or the like. Beneath the reception zone 6 for the body 5, the screw part 4 has an indentation 7, the formation of which causes an annular groove 8 in the external surface of the screw part 4, on the one hand, and a torus 9, which projects from the internal surface of the screw part 4, on the other hand. When the screw part 4 is inserted into the handle part 2, an internal bulge 10, formed at the upper end of the handle part 2, engages in the annular groove 8 in the screw part 4 in the manner of a snap connection. By this means, the screw part 4 is held so as to be undisplaceable in the longitudinal direction relative to the handle part 2 but can be rotated relative to the handle part 2. The internal bulge 10 may be formed by individual radial projections, but expediently the internal bulge is formed so as to extend in a ring-like manner on the internal surface of the handle part 2. Both the annular groove 8 and the internal bulge 10 are provided at a distance from the nearest end, thus causing centering to be brought about when the screw part 4 has been inserted into the handle part 2. By this means, the stability of the pencil is also increased.

As can be furthermore seen in FIG. 2, the screw part 4 has on its internal surface a thread 11 which co-operates with an external thread 12 formed on the plunger 3. The thread 11 is expediently formed by being rolled on the torus 9 projecting from the internal surface of the screw part 4, for example a metric thread having a pitch of 0.5 mm having been rolled thereon in a non-cutting manner.

The plunger 3 is arranged in the handle part 2 so as to be secured against rotation but so as to be longitudinally displaceable. For this purpose, the end of the plunger 3 that is at the handle end is provided with a radial projection 13 in the form of a rib which co-operates with a continuous longitudinally extending keyway 14 on the internal surface of the handle part 2. As can be clearly seen in FIG. 1, the radial projection 13 rides in keyway 14 of the handle part 2. This ensures both a securing against rotation of the plunger 3 and a longitudinal guidance of the plunger 3.

The operation of the pencil is as follows. If the spreadable body 5 is to be extended further from the screw part 4, then the screw part 4 is rotated. By this means, the thread 11 co-operates with the external thread 12 of the plunger 3. However, since the plunger 3 is arranged in the handle part 2 so as to be secured against rotation but so as to be axially displaceable, the plunger 3 is thereby caused to be moved relative to the screw part 4 and with its front face presses the spreadable body 5 from the screw part 4. By this means, the spreadable body 5 is indeed extended but at the same time the screw part 4 is prevented from being inserted into the interior of the handle part 2 and a shortening of the length projecting beyond the handle part 2.

Figure 5:
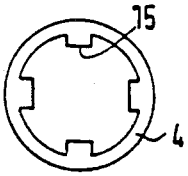
FIGS. 5 and 6 show sectional views of the screw part, as shown in FIG. 2, in the reception zone of the spreadable body.
Figure 6:
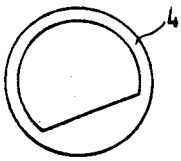

In order to be able to withstand bending stresses, in particular, the screw part is expediently made of metal. In order to allow the lead part of the spreadable body 5 to be sharpened to the shape shown in FIG. 1, the body is accommodated in the screw part 4 so as to be secured against rotation. As shown in FIGS. 5 and 6, this is effected by way of formlocking. According to FIG. 5, several longitudinal ribs 15 have been formed for this purpose in the reception zone 6 of the screw part 4, which are distributed about the circumference as shown. According to FIG. 6, there is used a screw part 4 having a non-circular cross section. A hexagonal or oval cross section is particularly suitable therefor.

What I claim is:

1. A holder dispenser of a cosmetic pencil type comprising a hollow handle part formed with an internal bulge, an externally threaded plunger mounted within said handle part fixed against rotative but permitting axial movement relative thereto, and a rotatable sleeve-shaped screw part fitted at its inner end portion at least in part within said hollow handle part between and in partial engagement with the inner surface of the handle part and the outer surface of the threaded plunger, said screw part inner end portion fitted within said hollow handle part being formed with an annular depression defining an annular groove in its outer surface and an annular indentation in its inner surface defining a torus, said annular identation being provided with a thread, said bulge on the handle part being received in said annular groove on mounting said screw part within said handle part and said thread provided on said indentation mating with the external threads of the plunger, the arrangement being such as to permit rotation of such screw part relative to said handle part by virtue of said bulge and groove connection while permitting, during said relative rotation, said axial movement of said plunger due to mating of said external threads on the plunger with said thread on said indentation.

2. A holder dispenser according to claim 1, wherein the screw part, by virtue of said bulge being received in the groove, is held in the handle part against movement in the axial direction.

3. A holder dispenser as claimed in claim 1, wherein the screw part is held in the handle part by a snap connection between said annular groove and said annular bulge.

4. A holder dispenser as claimed in claim 1, wherein the internal bulge is ring-shaped.

5. A holder dispenser as claimed in claim 4, wherein the internal bulge is formed on the end of the handle part that is at the screw part end, and the annular groove is formed so as to be a short distance from the end of the screw part that is at the handle part end.

6. A holder dispenser as claimed in claim 1, wherein the plunger has a radial projection which rides in a longitudinally extending keyway in the internal surface of the handle part.

7. A holder dispenser as claimed in claim 6, wherein the radial projection of the plunger is formed on the end thereof that is at the handle part end, the keyway extending from the bottom of the handle part substantially as far as the internal bulge in the handle part.

8. A holder dispenser as claimed in claim 1, wherein means is provided in the screw part for securing the spreadable body against rotation in the screw part.

9. A holder dispenser as claimed in claim 8, wherein said means comprises spaced apart longitudinal ribs provided in a reception zone in the screw part or said spreadable body.

10. A holder dispenser as claimed in claim 1, wherein the screw part is formed of a metal.

* * * * *